US012146673B2

(12) United States Patent
Choi et al.

(10) Patent No.: US 12,146,673 B2
(45) Date of Patent: Nov. 19, 2024

(54) APPARATUS AND METHOD FOR SETTING COMBINATION DESIRED TEMPERATURE FOR AIR CONDITIONERS INSTALLED IN TARGET ZONE, AND METHOD FOR CALCULATING BASE RELATIONSHIP INFORMATION OF THE TARGET ZONE USING THE SAME

(71) Applicant: SEEDN CO., LTD, Seoul (KR)

(72) Inventors: Hyun Woong Choi, Seongnam-si (KR); Won Jin Hong, Gwangju-si (KR)

(73) Assignee: SEEDN CO., LTD., Seoul (KR)

( * ) Notice: Subject to any disclaimer, the term of this patent is extended or adjusted under 35 U.S.C. 154(b) by 0 days.

(21) Appl. No.: 18/312,933

(22) Filed: May 5, 2023

(65) Prior Publication Data

US 2024/0125504 A1 Apr. 18, 2024

(30) Foreign Application Priority Data

Oct. 14, 2022 (KR) ..... 10-2022-0132555

(51) Int. Cl.
*F24F 11/62* (2018.01)
*F24F 11/46* (2018.01)
*F24F 110/10* (2018.01)

(52) U.S. Cl.
CPC ..... *F24F 11/62* (2018.01); *F24F 11/46* (2018.01); *F24F 2110/10* (2018.01)

(58) Field of Classification Search
CPC ..... F24F 11/62; F24F 11/46; F24F 2110/10
See application file for complete search history.

(56) References Cited

U.S. PATENT DOCUMENTS 4,505,259 A * 3/1985 Seppanen ..... F24D 11/007 126/633
2011/0056673 A1* 3/2011 Jang ..... F24F 11/62 165/201

FOREIGN PATENT DOCUMENTS

CN 105020837 A * 11/2015
JP S5956036 A * 3/1984
(Continued)

OTHER PUBLICATIONS

Odane, Air Conditioning System, Aug. 6, 1999, JPH11211187A, Whole Document (Year: 1999).*
(Continued)

*Primary Examiner* — Larry L Furdge
(74) *Attorney, Agent, or Firm* — United One Law Group LLC; Kongsik Kim; Jhongwoo Peck

(57) ABSTRACT

An apparatus and a method for setting a combination desired temperature for a plurality of air conditioners installed in a target zone, and a method for calculating base relationship information of the target zone include setting a combination desired temperature of a top-priority air conditioner among the air conditioners by at least one test driving of the top-priority air conditioner, the combination desired temperature of the top-priority air conditioner being a desired temperature of the top-priority air conditioner for realizing a comfortable temperature range of the target zone; and in response to a temperature of at least one temperature sensor among temperature sensors being outside the comfortable temperature range while the top-priority air conditioner is driven at the combination desired temperature of the top-priority air conditioner, adjusting the combination desired temperature of the first air conditioner through test driving of the first air conditioner.

14 Claims, 10 Drawing Sheets

(56) References Cited

FOREIGN PATENT DOCUMENTS

| | | | | |
|---|---|---|---|---|
| JP | S6237018 | A | * | 2/1987 |
| JP | H11211187 | A | * | 8/1999 |
| JP | 2016-099092 | A | | 5/2016 |
| KR | 10-2287293 | B1 | | 8/2021 |

OTHER PUBLICATIONS

Sugio, Temperature Controlling Method of Air Conditioner, Mar. 31, 1984, JPS5956036A, Whole Document (Year: 1984).*
Zhanli et al., Comfort Control Method and Device for Air Conditioner, Nov. 4, 2015, CN105020837A, Whole Document (Year: 2015).*
Nishikawa et al., Power Demand Controller, Feb. 18, 1987, JPS6237018A, Whole Document (Year: 1987).*

* cited by examiner

APPARATUS AND METHOD FOR SETTING COMBINATION DESIRED TEMPERATURE FOR AIR CONDITIONERS INSTALLED IN TARGET ZONE, AND METHOD FOR CALCULATING BASE RELATIONSHIP INFORMATION OF THE TARGET ZONE USING THE SAME

CROSS-REFERENCE TO RELATED APPLICATION

This application claims priority from Korean Patent Application No. 10-2022-0132555 filed on Oct. 14, 2022, which is incorporated herein by reference in its entirety.

BACKGROUND

1. Technical Field

Exemplary embodiments of the present invention relate to an apparatus and a method for setting a combination desired temperature for air conditioners installed in a target zone, and a method for calculating base relationship information of the target zone using the same.

2. Background Art

A cooling and heating device (or air conditioner) is a device that uses a cooling cycle to keep an indoor temperature comfortable for a person. The air conditioner inhales the hot air in the room, cool the room by discharging the heat with a low temperature refrigerant to the room, or then heat the room by the opposite action.

In general, driving the air conditioner is controlled by a direct manipulation of the person. For example, in summer, when the room temperature is high, a user turns on the air conditioner, and sets a desired temperature of the turned-on air conditioner to be low in order to reduce a high room temperature quickly.

On the other hand, many users are located in spaces such as restaurants, cafes, and offices, and generally, a manager of the space directly controls the driving of air conditioner. However, there is a problem that the air conditioner cannot be efficiently driven due to the ignorance or indifference of the manager.

For example, in the summer, when the manager sets the desired temperature of the air conditioner to be high, the users can feel the heat, and the user may feel the cold when the manager sets the desired temperature of the air conditioner to be low. As a result, the users feel uncomfortable. Moreover, when the desired temperature of the air conditioner is set to be low in the summer, the power consumption of the air conditioner is increased, and as a result, there is a problem in that electricity cost of the space increases.

In particular, a plurality of air conditioners may be installed in one space having a large size or zone. In this case, there is a problem in that when all of the plurality of air conditioners are driven, unnecessary power is consumed due to driving of an unnecessary air conditioner.

In addition, when all of the plurality of air conditioners are driven, there is a problem in that an indoor temperature at a specific point within a zone cannot reach a comfortable temperature due to driving of an unnecessary air conditioner, and excessive cooling/heating occurs, and unnecessary power is consumed. Further, even when some of the plurality of air conditioners are driven, there is a problem in that indoor temperatures at some points within the zone cannot reach the comfortable temperature. Therefore, the technology is required for the manager to efficiently drive the air conditioner without directly manipulating the air conditioner.

SUMMARY

An object of the present invention is to provide an apparatus and a method for setting a combination desired temperature for air conditioners installed in a target zone, which prevent driving of an unnecessary air conditioner among a plurality of air conditioners, prevent excessive cooling/heating which occurs at some points, and minimize power consumption while an indoor temperature at each point of the target zone satisfies a comfortable temperature range.

Further, an object of the present invention is to provide a method for calculating base relationship information of the target zone, which is used for predicting a temperature change of the target zone when one or more air conditioners among a plurality of air conditioners are turned on.

The objects of the present disclosure are not limited to the above-mentioned objects, and other objects and advantages of the present disclosure that are not mentioned can be understood by the following description, and will be more clearly understood by exemplary embodiments of the present disclosure. Further, it will be readily appreciated that the objects and advantages of the present disclosure can be realized by means and combinations shown in the claims.

According to an exemplary embodiment of the present invention, a method for setting a combination desired temperature of air conditioners of a target zone includes: setting, based on at least one test driving of a top-priority air conditioner among the air conditioners, a desired temperature of the top-priority air conditioner for implementing an indoor temperature of the target zone most similar to a comfortable temperature range of the target zone as a combination desired temperature of the top-priority air conditioner; and when indoor temperature of at least one temperature sensor among the temperature sensors of the target zone are not included in the comfortable temperature range in a situation in which the top-priority air conditioner is driven at a corresponding combination desired temperature, setting desired temperature of at least one air conditioner which make the indoor temperature of the target zone and the indoor temperatures of the temperature sensors be included in the comfortable temperature range among air conditioners other than the top-priority air conditioner as the combination desired temperature of the at least one air conditioner based on at least one test driving of the air conditioners other than the top-priority air conditioner.

Further, according to another exemplary embodiment of the present invention, a method for calculating base relationship information used for predicting a temperature change of a target zone includes: setting combination desired temperatures of one or more air conditioners which are combined and driven among air conditioners installed in the target zone; collecting a plurality of base information measured when the one or more air conditioners are driven at corresponding combination desired temperatures; and calculating base relationship information between an indoor/outdoor temperature difference of the target zone and a temperature change of the target zone in a situation in which the one or more air conditioners are driven at the corresponding combination desired temperatures based on the plurality of base information. In this case, the setting of the combination desired temperatures of the one or more air conditioners includes setting, based on at least one test driving of a top-priority air conditioner among the air conditioners, a desired temperature of the top-priority air conditioner for implementing an indoor temperature of the target zone most similar to a comfortable temperature range of the target zone as a combination desired temperature of the top-priority air conditioner, and when indoor temperature of at least one temperature sensor among the temperature sensors of the target zone are not included in the comfortable temperature range in a situation in which the top-priority air conditioner is driven at a corresponding combination desired temperature, setting desired temperature of at least one air conditioner which make the indoor temperature of the target zone and the indoor temperatures of the temperature sensors be included in the comfortable temperature range among air conditioners other than the top-priority air conditioner as the combination desired temperature of the at least one air conditioner based on at least one test driving of the air conditioners other than the top-priority air conditioner.

Further, according to an exemplary embodiment of the present invention, an apparatus for setting combination desired temperatures of air conditioners includes: a memory storing a computer-readable instruction; and a processor implemented to execute the instruction. In this case, the processor sets, based on at least one test driving of a top-priority air conditioner among the air conditioners, a desired temperature of the top-priority air conditioner for implementing an indoor temperature of the target zone most similar to a comfortable temperature range of the target zone as a combination desired temperature of the top-priority air conditioner, and when indoor temperature of at least one temperature sensor among the temperature sensors of the target zone are not included in the comfortable temperature range in a situation in which the top-priority air conditioner is driven at a corresponding combination desired temperature, sets desired temperature of at least one air conditioner which make the indoor temperature of the target zone and the indoor temperatures of the temperature sensors be included in the comfortable temperature range among air conditioners other than the top-priority air conditioner as the combination desired temperature of the at least one air conditioner based on at least one test driving of the air conditioners other than the top-priority air conditioner.

According to the present invention, a combination desired temperature of one or more air conditioners among a plurality of air conditioners is calculated to minimize power consumption while an indoor temperature of each point of a target zone satisfies a comfortable temperature range, prevent driving of an unnecessary air conditioner, and prevent excessive cooling/heating at some points.

Further, according to the present invention, base relationship information of the target zone when one or more air conditioners among the plurality of air conditioners is calculated to accurately predict temperature change information of the target zone.

In addition, the effect of the present invention is not limited to the above effects, and should be understood to include all the effects that can be inferred from the configuration of the present invention described in the detailed description or the claim of the present invention.

DETAILED DESCRIPTION

Figure 1:
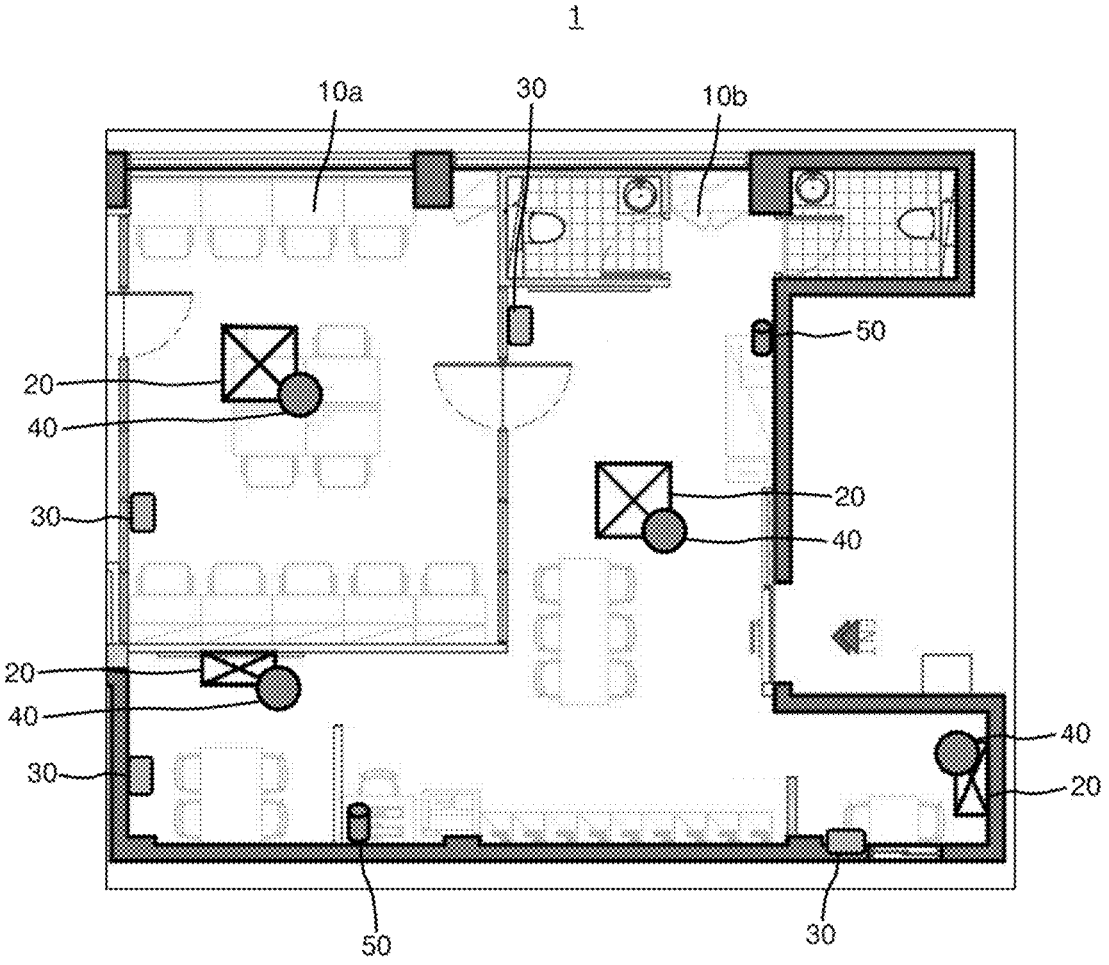
FIG. 1 is a diagram illustrating a schematic configuration of a space according to an exemplary embodiment of the present invention.

The present invention may be variously modified and have several embodiments, and thus, specific embodiments will be illustrated in the accompanying drawings and be described in detail. However, it is to be understood that the present invention is not limited to a specific exemplary embodiment, but includes all modifications, equivalents, and substitutions included in the scope and spirit of the present invention. In describing each drawing, similar reference numerals are used for similar components.

The terms such as "first," "second," or the like, may be used to describe various components, but these components are not to be construed as being limited to these terms. The terms are used only to distinguish one component from another component. The term "and/or" includes a combination of a plurality of related described items or any one of the plurality of related described items.

The terms used in the present specification are used only to describe specific embodiments rather than limiting the present invention. Singular forms are intended to include plural forms unless the context clearly indicates otherwise. It is to be understood that the term "include" or "have" used herein specifies the presence of features, numbers, steps, operations, components, parts, or combinations thereof mentioned in the present specification, or combinations thereof, but does not preclude the presence or addition of one or more other features, numbers, steps, operations, components, parts, or combinations thereof.

Hereinafter, exemplary embodiments of the present invention will be described in detail with reference to the accompanying drawings.

FIG. 1 is a diagram illustrating a schematic configuration of a space 1 according to an exemplary embodiment of the present invention.

Referring to FIG. 1, the space 1 includes a plurality of zones 10*a* and 10*b*. The plurality of zones 10*a* and 10*b* may be distinguished by an inner wall. The plurality of zones 10*a* and 10*b* may be divided by the inner wall and may have different indoor temperatures and humidities.

An air conditioner 20, a temperature/humidity sensor 30, and a control module 40 may be installed in each of the plurality of zones 10*a* and 10*b*. Further, a gateway 50 may be installed in at least a partial zone 10*b* of the plurality of zones 10*a* and 10*b*. Meanwhile, although not illustrated in FIG. 1, an access point 60 (see FIG. 2) may be further installed in a specific zone among the plurality of zones 10*a* and 10*b*.

Hereinafter, the present invention will be described by assuming the zone 10*b* in which the gateway 50 is installed as the target zone 10.

Figure 2:
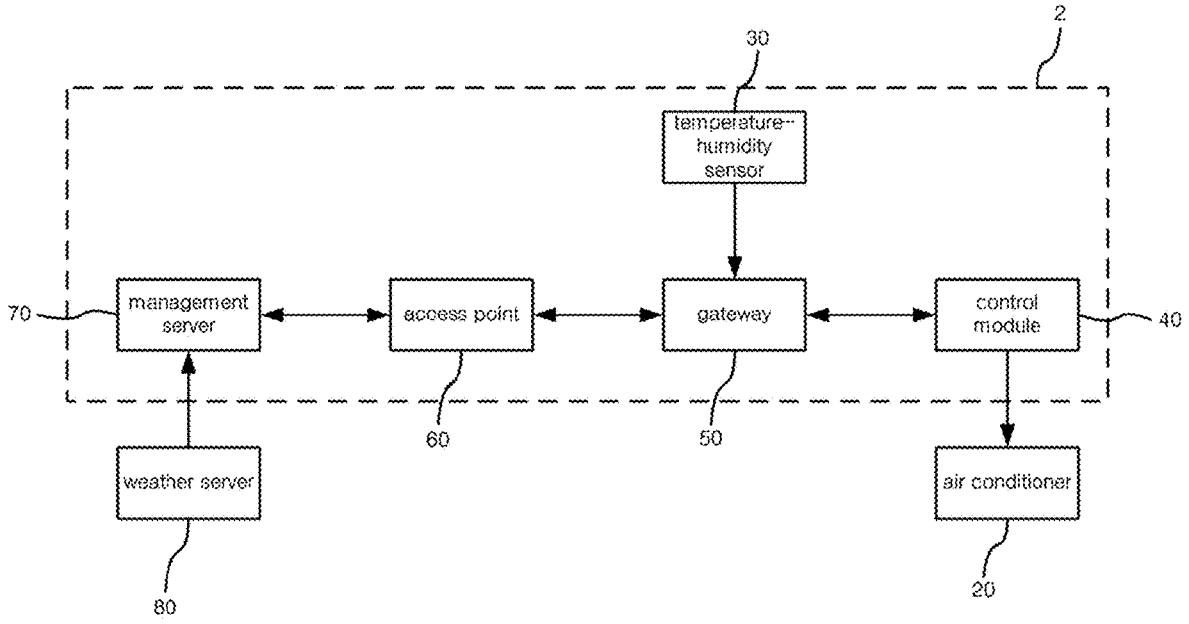
FIG. 2 is a diagram illustrating a schematic configuration of an air conditioner control system according to an exemplary embodiment of the present invention.

FIG. 2 is a diagram illustrating a schematic configuration of an air conditioner control system 2 according to an exemplary embodiment of the present invention.

Referring to FIG. 2, the air conditioner control system 2 includes a temperature/humidity sensor 30, a control module 40, a gateway 50, an access point 60, and a management server 70.

The temperature/humidity sensor 30 may measure the indoor temperature and humidity of the target zone 10. To this end, the temperature-humidity sensor 30 may include a temperature sensor module and a humidity sensor module.

The temperature/humidity sensor 30 may be installed in a location where the temperature and humidity of a zone where a person is primarily active, but is not limited thereto, and the temperature/humidity sensor 30 may also be built in the air conditioner 20.

The temperature/humidity sensor 30 may perform communication with another electronic device in the target zone 10. To this end, the temperature/humidity sensor 30 may include a short-range communication module. As an example, the temperature/humidity sensor 30 may include a Bluetooth communication module, but the present invention is not limited thereto.

The control module 40 may be a device transmitting a driving control signal for controlling the driving of the air conditioner 20 to the air conditioner 20. The control module 40 may be installed in a specific part of the target zone 10 adjacent to the air conditioner 20. As described later, the driving control signal may be generated by the management server 70 and transmitted from the management server 70 to the control module 40 through the access point 60 and the gateway 50.

To this end, the control module 40 may include a short-range communication module and an infrared data association (IrDA) module. For example, the control module 40 may have a Bluetooth communication module, but the present invention is not limited thereto.

The gateway 50 may communicate with each of the temperature/humidity sensor 30, the control module 40, and the access point 60. To this end, the gateway 50 may include a first short-range communication module for communication connection with the temperature/humidity sensor 30 and the control module 40, and a second short-range communication module for communication connection with the access point 60. For example, the first short-range communication module may be the Bluetooth communication module, and the second short-range communication module may be a Wireless Fidelity (WiFi) communication module, but the present invention is not limited thereto.

The gateway 50 may receive indoor temperature and humidity information from the temperature/humidity sensor 30, and then transmit the indoor temperature/humidity information to the access point 60. In addition, the gateway 50 may receive the driving control signal of the air conditioner 20 to be described later from the access point 60, and then transmit the driving control signal to the control module 40. In addition, the gateway 50 may also receive driving-related data of the air conditioner 20 from the control module 40.

The access point 60 may relay communication between the gateway 50 and the management server 70. To this end, the access point 60 may include the second short-range communication module and a long-range communication module.

The management server 70 may be a device for actually controlling the air conditioner 20. The management server 70 may be communication connected with the access point 60 and a weather server 80. The management server 70 may receive the indoor temperature and humidity information of the target zone 10 from the access point 60, and receive weather information of the target zone 10 from the weather server 80. The management server 70 may generate the driving control signal of the air conditioner 20 using the indoor temperature and humidity information and the weather information of the target zone 10, and transmit the driving control signal to the access point 60.

The weather server 80 may be a server that provides the weather information for each administrative district. The weather information may be predicted information. The weather information may include an outdoor temperature, a cloud quantity, a precipitation probability, and a humidity.

Meanwhile, in order to make the indoor temperature of each point of the target zone 10 be included in the comfortable temperature range, one or more air conditioners 20 among the air conditioners 20 may be combined and driven. Hereinafter, the management server 70 will be described in more detail, which calculates a combination desired temperature of one or more air conditioners 20 when one or more air conditioners 20 are combined and driven, and calculates the base relationship information based on base information measured in a situation in which one or more air conditioners 20 are driven at a predetermined combination desired temperature.

Figure 3:
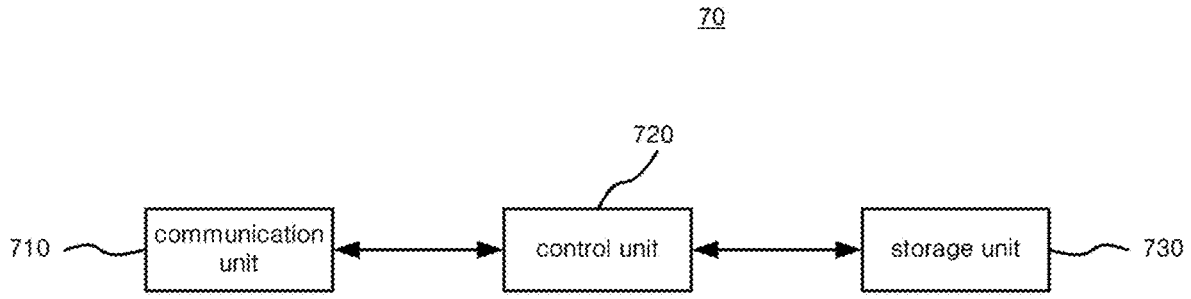
FIG. 3 is a diagram illustrating a schematic configuration of a management server according to an exemplary embodiment of the present invention.
Figure 4:
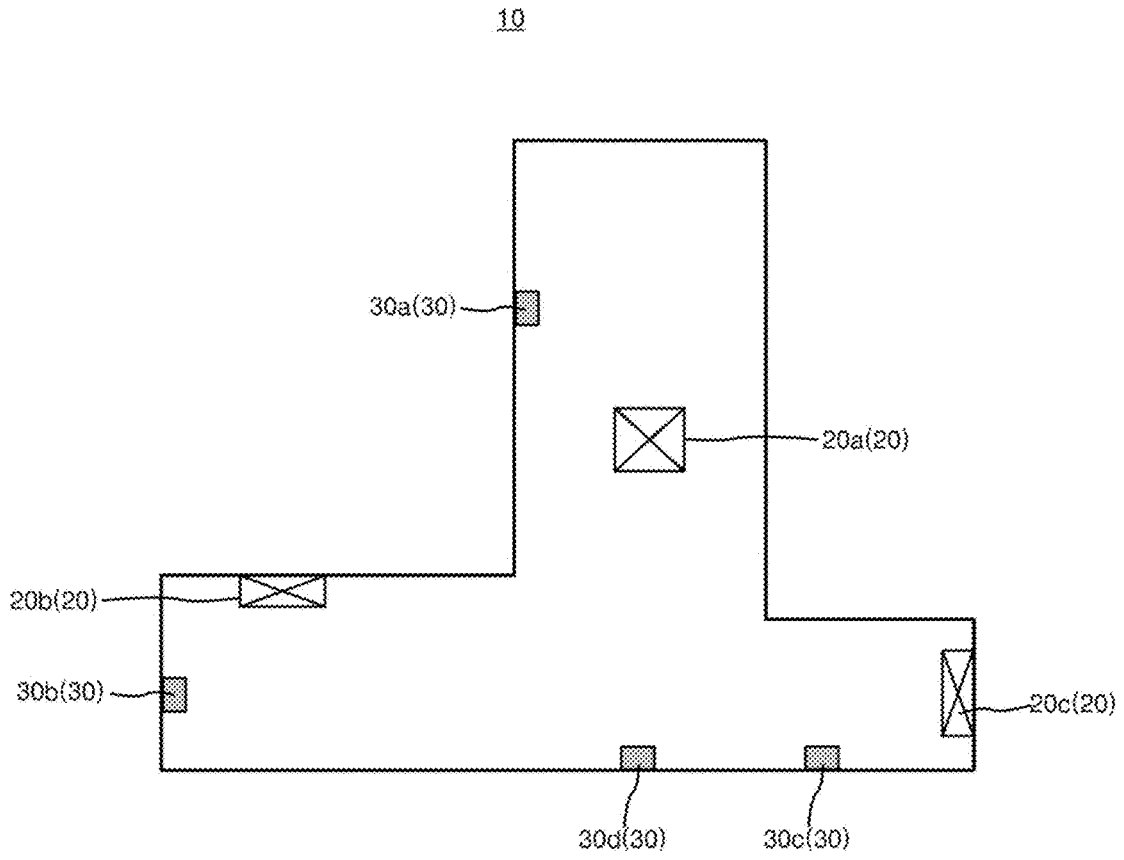
FIG. 4 is a diagram briefly illustrating a target zone in the space of FIG. 1.

FIG. 3 is a diagram illustrating a schematic configuration of a management server 70 according to an exemplary embodiment of the present invention, and FIG. 4 is a diagram briefly illustrating a target zone 10 in the space 1 of FIG. 1.

Here, three air conditioners 20: 20*a*, 20*b*, and 20*c*, and four temperature/humidity sensors 30: 30*a*, 30*b*, 30*c*, and 30*d* are installed in the target zone 10. Meanwhile, the numbers of air conditioners 20 and temperature/humidity sensors 30 installed in the target zone 10 are not limited to those in FIG. 4, and for convenience of description, the "temperature/humidity sensor 30" will be referred to as "temperature sensor 30".

Referring to FIG. 3, the management server 70 may include a communication unit 710, a control unit 720, and a storage unit 730.

Hereinafter, the function will be described in detail for each component.

The communication unit 710 may be a module that performs communication with the access point 60. For example, the communication unit 710 may include the long-range communication module implemented in a wired and wireless scheme, but the present invention is not limited thereto.

As described above, the communication unit 710 may receive indoor temperature information and indoor humidity information measured by a plurality of temperature sensors 20 through the access point 60.

The storage unit 730 may include a memory and a processor. The memory may be a volatile and/or non-volatile memory, and may store instructions or data related to at least one other component of the management server 70. A processor may include one or more of a central processing unit (CPU), an application processor, or a communication processor.

The control unit 720 may control the communication unit 710, and generate the driving control signal of the plurality of air conditioners 20. Here, the driving control signal may be a first driving control signal for controlling driving (i.e., test driving) of one or more air conditioners 20 among the plurality of air conditioners 20 at a test day, and may be a second driving control signal for controlling driving of one or more air conditioners 20 among the plurality of air conditioners 20 at a target day.

Further the control unit 720 may set the combination desired temperature of one or more air conditioners 20 based on the test driving of one or more air conditioners 20 among the plurality of air conditioners 20. Here, the combination desired temperature of each of one or more air conditioners 20 may be a desired temperature of each of one or more air conditioners 20 when one or more air conditioners 20 are simultaneously combined and driven. As an example, when two air conditioners 20*a* and 20*b* among three air conditioners 20 are driven, and one air conditioner 20*c* is not driven, a combination desired temperature for two air conditioners 20*a* and 20*b* may be set, and the combination desired temperature may not be set for one air conditioner 20*c*. The combination desired temperatures of one or more air conditioners 20 are used, and as a result, driving of an unnecessary air conditioner 20 may be prevented while indoor temperatures of respective points of the target zone 10 reach the comfortable temperature range. As an example, respective points in the target zone 10 may be installation points of the plurality of temperature sensors 30 in the target zone 10.

Moreover, the control unit 720 may calculate the base relationship information based on the combination desired temperature, and the temperature change of the target zone 10 when one or more air conditioners 20 are turned on at the combination desired temperature may be predicted based on the base relationship information. Here, the base relationship information may be defined as relationship information between the indoor/outdoor temperature difference of the target zone 10 and the temperature change of the target zone 10 when one or more air conditioners 20 are turned on at the combination desired temperature.

The storage unit 730 may store various information related to the driving control of the air conditioner 20.

Hereinafter, concepts of the comfortable temperature range, and a thermal influence of the air conditioner 20 are first defined, and then operations performed by the management server 70 will be described in detail with reference to FIG. 5.

1. Comfortable Temperature Range

Here, the comfortable temperature range may be defined as a felt temperature range at which a user positioned in the target zone 10 feels comfortable.

The comfortable temperature range may be set in a temperature section format. As an example, the comfortable temperature range may be set to "23.5° C. to 24.5° C.".

The comfortable temperature range may be set differently for each season. As an example, the comfortable temperature range in the summer may be higher than the comfortable temperature range in the winter.

The comfortable temperature range may also be set differently for each period included in a specific day. Here, a plurality of periods may mean a sequential time interval included in the target day. The plurality of periods may be set based on an operation schedule for the target zone 10.

A unit time defined as a length of the period may be variously set. As an example, the unit time may be set to 1 hour. Accordingly, a comfortable temperature range during a period of "7:00 to 7:59" and a comfortable temperature range during a period of "8:00 to 8:59" may be individually set.

Meanwhile, a non-comfortable temperature range which is a temperature range other than the comfortable temperature range may be defined. In this case, first and second non-comfortable temperature ranges may be defined based on the comfortable temperature range.

Here, the first non-comfortable temperature range may be defined as a temperature range having a higher cooling/heating load than the comfortable temperature range, and the second non-comfortable temperature range may be defined as a temperature range having a lower cooling/heating load than the comfortable temperature range.

That is, the first non-comfortable temperature range may have a higher temperature than the comfortable temperature range in the cooling mode, and have a lower temperature than the comfortable temperature range in the heating mode. The second non-comfortable temperature range may have a lower temperature than the comfortable temperature range in the cooling mode, and have a higher temperature than the comfortable temperature range in the heating mode.

As an example, when the air conditioner 20 is driven in the cooling mode, and the comfortable temperature range in the summer is set to "23.5° C. to 24.5° C.", the first non-comfortable temperature range may be a temperature range of 24.6° C. or higher and the second non-comfortable temperature range may be a temperature range of 23.4° C. or lower. As another example, when the air conditioner 20 is driven in the heating mode, and the comfortable temperature range in the winter is set to "25.5° C. to 26.5° C.", the first non-comfortable temperature range may be a temperature range of 25.4° C. or lower and the second non-comfortable temperature range may be a temperature range of 26.6° C. or higher.

2. Thermal Influence of Air Conditioner 20

The thermal influence of the air conditioner 20 may be defined as an influence exerted on the indoor temperature of the target zone 10. That is, since installation locations, cooling capacities, power consumptions, and energy consumption efficiencies of respective air conditioners 20 installed in the target zone 10 may be different from each other, the thermal influences of the air conditioners 20 may be different from each other.

The thermal influences of the respective air conditioners 20 may be preset by the management server 70 before performing steps in FIG. 5 described below. In particular, the management server 70 may set an air conditioner 20 having a largest thermal influence exerted on the indoor temperature of the target zone 10 among the air conditioners 20 as a top-priority air conditioner 20.

The thermal influence of the air conditioner 20 may be set based on at least one of a first thermal influence and a second thermal influence.

The first thermal influence of the air conditioner 20 may correspond to a degree at which the indoor temperatures of the respective points in the target zone 10 are evenly changed. In other words, the first thermal influence of the air conditioner 20 may correspond to a degree indicating how the amount of indoor temperature change of the respective points in the target zone 10 are distributed when driving the air conditioner 20. Here, the respective points may include installation points of the plurality of temperature/humidity sensors 20.

The first thermal influence of the air conditioner 20 and the distribution degree of the amount of indoor temperature change of the respective points in the target zone 10 may have an inverse proportional relationship to each other. That is, as the first thermal influence of the air conditioner 20 is the larger, the distribution degree of the amount of indoor temperature change of the respective points in the target zone 10 may be the smaller, and as the first thermal influence of the air conditioner 20 is the smaller, the distribution degree of the amount of indoor temperature change of the respective points in the target zone 10 may be the larger.

The second thermal influence of the air conditioner 20 may correspond to a degree of changing the entire (i.e. overall) indoor temperature of the target zone 10. In other words, the second thermal influence of the air conditioner 20 may correspond to the amount of the entire indoor temperature change of the target zone 10 when driving the air conditioner 20.

As the second thermal influence of the air conditioner 20 is the larger, the amount of the entire indoor temperature change of the target zone 10 becomes the larger, and the entire indoor temperature of the target zone 10 may be rapidly changed. Further, as the second thermal influence of the air conditioner 20 becomes the smaller, the amount of the entire indoor temperature change of the target zone 10 may be the smaller, and the entire indoor temperature of the target zone 10 may be slowly changed.

As an example, the thermal influence of the air conditioner 20 may correspond to a total sum value of a value acquired by adding a first weight to the first thermal influence and a value acquired by adding a second weight to the second thermal influence. The first and second weights may be set to be different from each other based on an air conditioner driving mode (for example, an energy saving mode, an energy equalization mode, etc.).

Hereinafter, the "thermal influence" will be written as "influence".

3. Combination Desired Temperature Setting and Resulting Base Relationship Information Calculating FIG. 5 is a diagram illustrating a flowchart of a method for calculating base relationship information of a target zone 10 according to an exemplary embodiment of the present invention.

As described above, the method for calculating the base relationship information of the target zone 10 may be performed by the management server 70.

Hereinafter, a process performed for each step will be described in detail. In this case, the exemplary embodiment is described by assuming the temperature sensor 20 as the temperature sensor 30.

In step S10, the management server 70 may set the combination desired temperature which is a desired temperature of each of one or more air conditioners 20 combined and driven among the air conditioners 20 installed in the target zone 10 so that both the indoor temperature of the target zone 10 and the indoor temperatures of the temperature sensors 30 are included in the comfortable temperature range.

Here, the indoor temperature of the target zone 10 may correspond to the indoor temperature of the entire target zone 10, and the indoor temperatures of the temperature sensors 30 may correspond to the indoor temperatures of the respective points at which the temperature sensors 30 are installed.

Step S10 may be performed during a specific time interval of the test day.

Hereinafter, a detailed process of step S10 will be described in detail with reference to FIG. 6.

Figure 5:
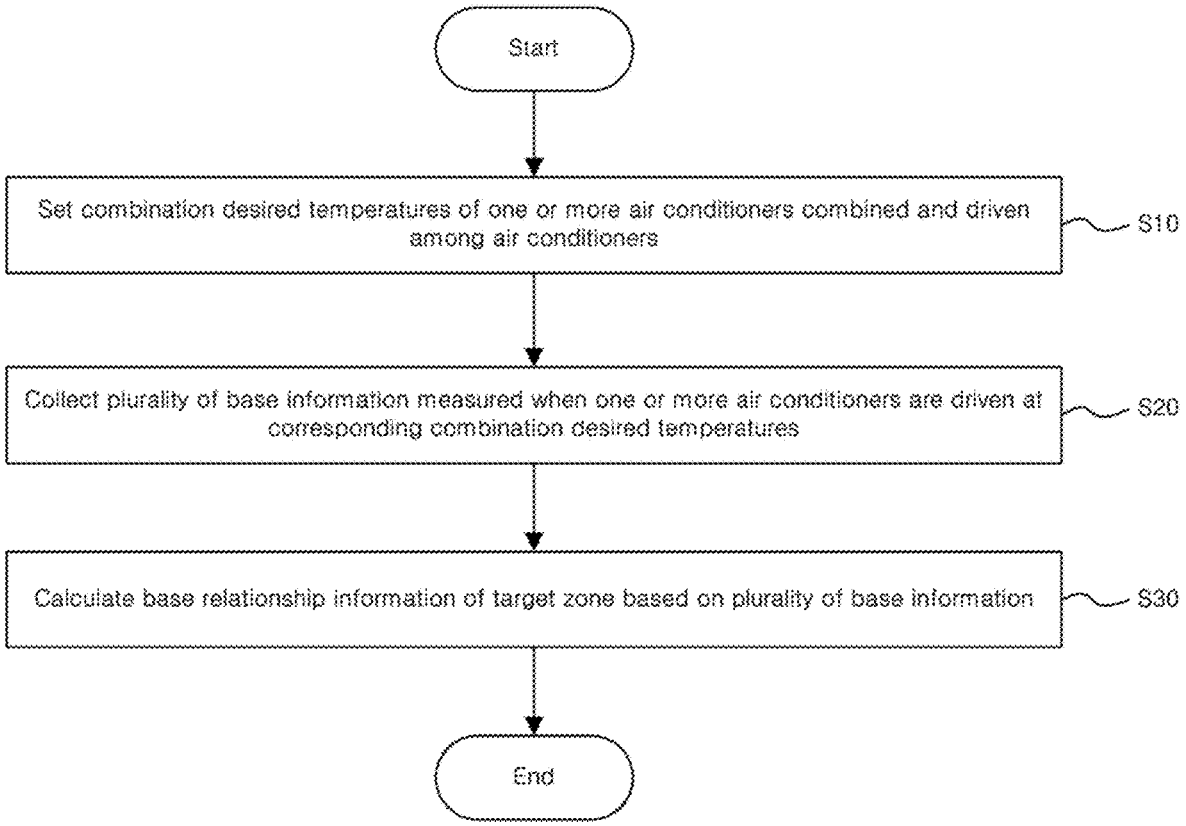
FIGS. 5 to 8 are diagrams illustrating a flowchart of a method for calculating base relationship information of a target zone according to an exemplary embodiment of the present invention.
Figure 6:
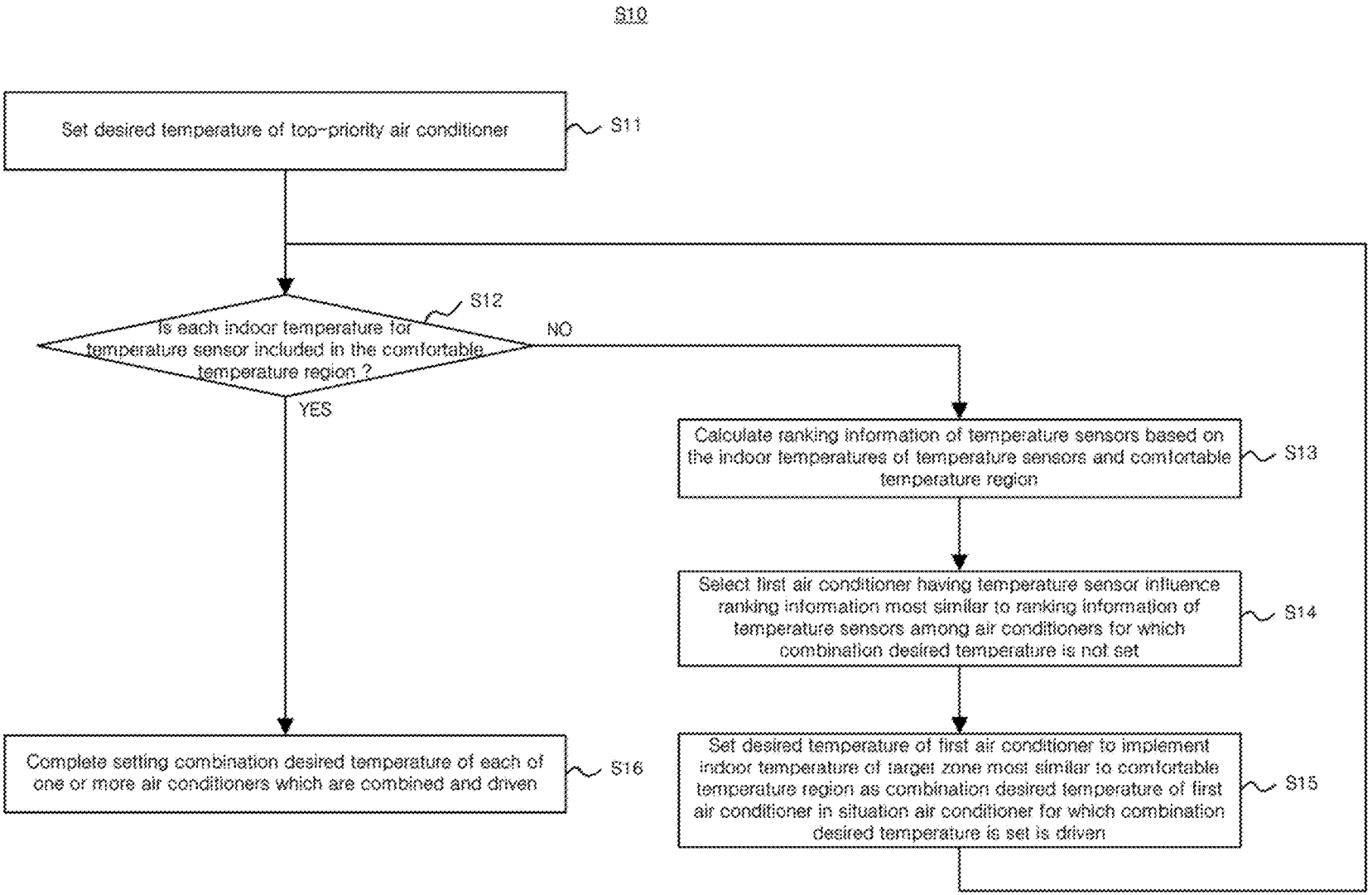

FIG. 6 is a diagram illustrating a flowchart of step S10 in FIG. 5.

In step S11, the management server 70 may set a desired temperature of the top-priority air conditioner 20 for implementing (i.e. realizing) the indoor temperature of the target zone 10 most similar to the comfortable temperature range as the combination desired temperature of the top-priority air conditioner 20.

Here, the indoor temperature of the target zone 10 most similar to the comfortable temperature range may also be the indoor temperature of the target zone 10 included in the comfortable temperature range, and may be the indoor temperature of the target zone 10 included in the first non-comfortable temperature range and most adjacent to the comfortable temperature range.

Figure 7:
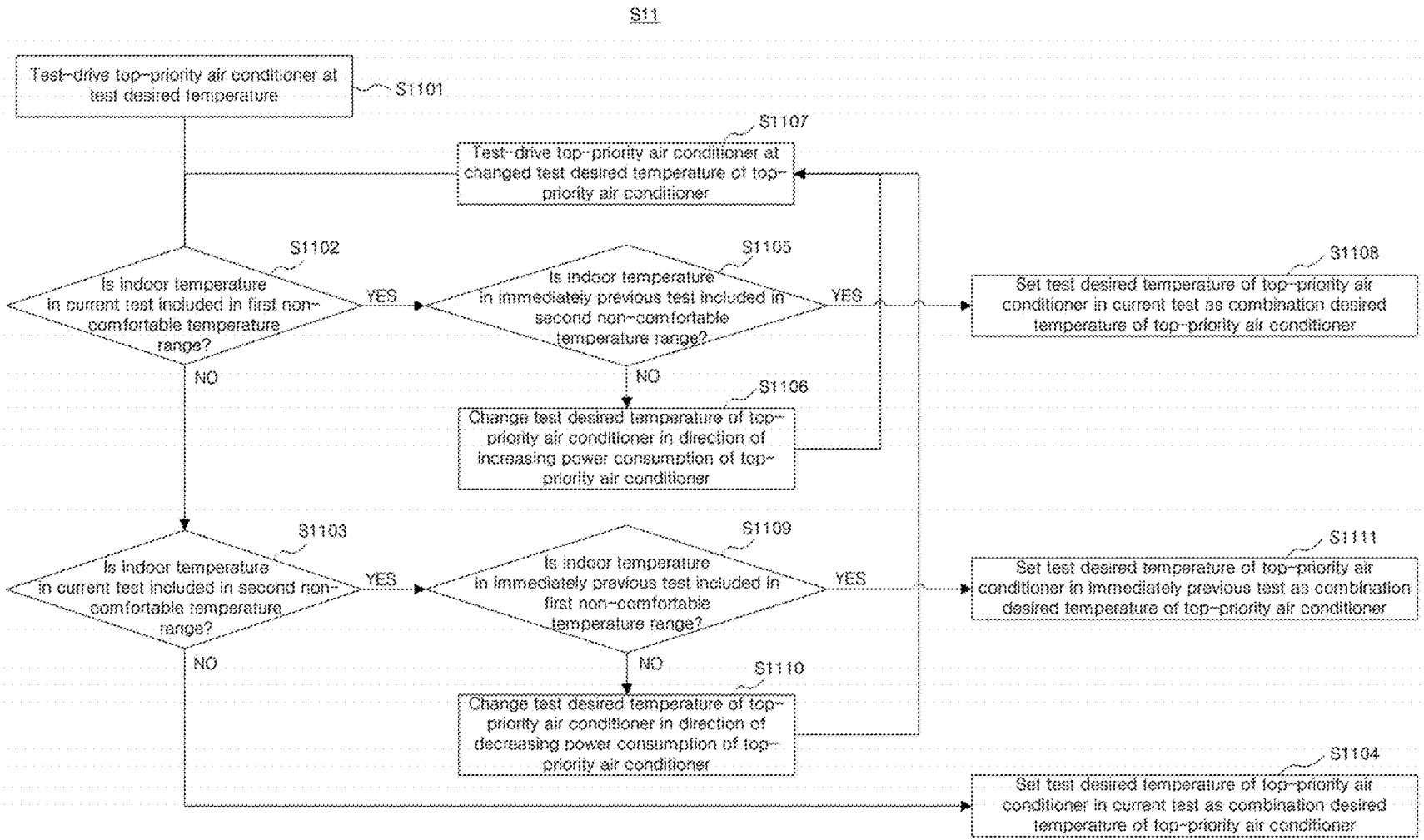

FIG. 7 is a diagram illustrating a flowchart of step S11 in FIG. 6. Hereinafter, a process performed for each step will be described.

In step S1101, the management server 70 may control to test-drive the top-priority air conditioner 20 at a default test desired temperature. As a result, the top-priority air conditioner 20 may be test-driven.

As an example, a driving hour of the test driving may be 40 minutes or more, and upon first test driving, a predetermined default test desired temperature may be 24° C.

In step S1102, the management server 70 may determine whether the indoor temperature of the target zone 10 in a current test is included in the first non-comfortable temperature range. When the indoor temperature of the target zone 10 is included in the first non-comfortable temperature range, steps S1105 to step S1108 may be performed. When the indoor temperature of the target zone 10 is not included in the first non-comfortable temperature range, step S1103 may be performed.

Meanwhile, the indoor temperature of the target zone 10 may correspond to an average value of the indoor temperatures measured by the respective temperature sensors installed in the target zone 10. Further, the indoor temperature of the target zone 10 may be a convergence value of the indoor temperatures directly measured by the temperature sensors 30. That is, when the air conditioner 20 is continuously driven at a specific desired temperature, the indoor temperature of the target zone 10 is reduced by a predetermined value, and then maintained. Therefore, the converged indoor temperature may correspond to the maintained indoor temperature of the target zone 10, and this may be inferred based on a change rate of the indoor temperature of the target zone 10 in the test driving. Meanwhile, the present invention is not limited thereto, and the indoor temperature of the target zone 10 may also be an average value of the indoor temperatures directly measured by the temperature sensors 30.

When the indoor temperature of the target zone 10 is included in the non-comfortable temperature range, the management server 70 may determine whether the indoor temperature of the target zone 10 is included in the second non-comfortable temperature range in step S1105.

When the indoor temperature of the target zone 10 in the immediately previous test is not included in the second non-comfortable temperature range, the management server 70 may change the test desired temperature of the top-priority air conditioner 20 in a direction of increasing the power consumption of the top-priority air conditioner 20 in step S1106, and test-drive the top-priority air conditioner 20 at the test desired temperature of the top-priority air conditioner 20 changed in step S1107. Thereafter, step S1102 may be performed again. Here, the changed desired temperature corresponds to a sum of the unchanged desired temperature and a preset unit temperature (for example, 0.5° C. or 1° C.). Meanwhile, when the current test is a first test, there is no previous test, so the step S1106 may be performed.

Specifically, when the air conditioner 20 is driven in the cooling mode, the direction of increasing the power consumption of the top-priority air conditioner 20 may correspond to decreasing the test desired temperature of the air conditioner 20. In addition, when the air conditioner 20 is driven in the heating mode, the direction of increasing the power consumption of the top-priority air conditioner 20 may correspond to increasing the test desired temperature of the air conditioner 20.

On the contrary, when the indoor temperature of the target zone 10 in the immediately previous test is included in the second non-comfortable temperature range, the management server 70 may set the test desired temperature of the top-priority air conditioner 20 in the current test as the combination desired temperature of the top-priority air conditioner 20 in step S1108.

Meanwhile, the indoor temperature of the target zone 10 is not included in the first non-comfortable temperature range, the management server 70 may determine whether the indoor temperature of the target zone 10 is included in the second non-comfortable temperature range in step S1103. When the indoor temperature of the target zone 10 is included in the second non-comfortable temperature range, steps S1107, S1109, and S1110 may be performed. When the indoor temperature of the target zone 10 is not included in the second non-comfortable temperature range, step S1104 may be performed.

When the indoor temperature of the target zone 10 in the immediately previous test is not included in the first non-comfortable temperature range, the management server 70 may change the test desired temperature of the top-priority air conditioner 20 in a direction of decreasing the power consumption of the top-priority air conditioner 20 in step S1110, and test-drive the top-priority air conditioner 20 at the test desired temperature of the top-priority air conditioner 20 changed in step S1107. Thereafter, step S1102 may be performed again. Meanwhile, when the current test is a first test, there is no previous test, so the step S1109 may be performed.

Specifically, when the air conditioner 20 is driven in the heating mode, the direction of decreasing the power consumption of the top-priority air conditioner 20 may correspond to increasing the test desired temperature of the air conditioner 20. In addition, when the air conditioner 20 is driven in the heating mode, the direction of decreasing the power consumption of the top-priority air conditioner 20 may correspond to decreasing the test desired temperature of the air conditioner 20.

On the contrary, when the indoor temperature of the target zone 10 in the immediately previous test is included in the first non-comfortable temperature range, the management server 70 may set the test desired temperature of the top-priority air conditioner 20 in the immediately previous test as the combination desired temperature of the top-priority air conditioner 20 in step S1111.

Meanwhile, when the indoor temperature of the target zone 10 is not included in the second non-comfortable temperature range, the indoor temperature of the target zone 10 not being included in the second non-comfortable temperature range corresponds to the indoor temperature of the target zone 10 being included in the comfortable temperature range, so the management server 70 may set the test desired temperature of the top-priority air conditioner 20 in the current test as the combination desired temperature of the top-priority air conditioner 20 in step S1104.

Meanwhile, steps S1102 and S1103 may correspond to a step of determining whether the indoor temperature of the target zone 10 being included in the comfortable temperature range. Further, steps S1106 and S1110 may correspond to a step of changing the test desired temperature of the top-priority air conditioner 20.

Hereinafter, an example of FIG. 7 will be described separately in the cooling mode and the heating mode. In this case, it is assumed that the unit temperature is 1° C.

A) Cooling Mode Driving of Air Conditioner 20

When the comfortable temperature range of the test day is set to 24.5° C. to 25.5° C., the test desired temperature of the top-priority air conditioner 20 in the first test is set to 24° C., and the indoor temperature of the target zone 10 in the first test is 24.7° C., the management server 70 may set the test desired temperature (24° C.) of the top-priority air conditioner 20 in the current test (first test) as the combination desired temperature of the top-priority air conditioner 20 through "step S1102->step S1103->step S1104".

In addition, when the comfortable temperature range of the test day is set to 23.5° C. to 24.5° C., the test desired temperature of the top-priority air conditioner 20 in the first test is set to 24° C., and the indoor temperature of the target zone 10 in the first test is 24.9° C., the test driving may be performed twice, and the management server 70 may set the test desired temperature (24° C.) of the top-priority air conditioner 20 in the previous test (first test) as the combination desired temperature of the top-priority air conditioner 20 through step S1102->step S1105->step S1106->step S1107->step S1102->step S1103->step S1109->step S1111.

In addition, when the comfortable temperature range of the test day is set to 23.5° C. to 24.5° C., the test desired temperature of the top-priority air conditioner 20 in the first test is set to 23° C., and the indoor temperature of the target zone 10 in the first test is 23.1° C., the test driving may be performed twice, and the management server 70 may set the test desired temperature (24° C.) of the top-priority air conditioner 20 in the current test (second test) as the combination desired temperature of the top-priority air conditioner 20 through step S1102->step S1103->step S1109->step S1110->step S1107->step S1102->step S1105->step S1108.

B) Heating Mode Driving of Air Conditioner 20

When the comfortable temperature range of the test day is set to 25.8° C. to 26.3° C., the test desired temperature of the top-priority air conditioner 20 in the first test is set to 26° C., and the indoor temperature of the target zone 10 in the first test is 25.9° C., the management server 70 may set the test desired temperature (26° C.) of the top-priority air conditioner 20 in the current test (first test) as the combination desired temperature of the top-priority air conditioner 20 through "step S1102->step S1103->step S1104".

In addition, when the comfortable temperature range of the test day is set to 26.2° C. to 26.7° C., the test desired temperature of the top-priority air conditioner 20 in the first test is set to 26° C., and the indoor temperature of the target zone 10 in the first test is 25.9° C., the test driving may be performed twice, and the management server 70 may set the test desired temperature (26° C.) of the top-priority air conditioner 20 in the previous test (first test) as the combination desired temperature of the top-priority air conditioner 20 through step S1102->step S1105->step S1106->step S1107->step S1102->step S1103->step S1109->step S1111.

In addition, when the comfortable temperature range of the test day is set to 26.2° C. to 26.7° C., the test desired temperature of the top-priority air conditioner 20 in the first test is set to 27° C., and the indoor temperature of the target zone 10 in the first test is 26.9° C., the test driving may be performed twice, and the management server 70 may set the test desired temperature (26° C.) of the top-priority air conditioner 20 in the current test (second test) as the combination desired temperature of the top-priority air conditioner 20 through step S1102->step S1103->step S1109->step S1110->step S1107->step S1102->step S1105->step S1108.

For example, in step S11, the management server 70 may set the desired temperature of the top-priority air conditioner 20 for implementing the indoor temperature of the target zone 10 most similar to the comfortable temperature range of the target zone 10 as the as the combination desired temperature of the top-priority air conditioner 20 based on at least one test driving of the top-priority air conditioner 20. The combination desired temperature of the top-priority air conditioner 20 may be used when one or more air conditioners 20 are combined and driven.

Referring back to FIG. 6, after the combination desired temperature of the top-priority air conditioner 20 is set, in step S12, the management server 70 may determine whether each indoor temperature for temperature sensor is included in the comfortable temperature range.

That is, the indoor temperatures measured by the respective temperature sensors 30 may be different due to different installation locations of the temperature sensors 30, and as a result, the indoor temperatures of some temperature sensors 30 are included in the comfortable temperature range, but indoor temperatures of some other temperature sensors 30 may not be included in the comfortable temperature range. Such a situation may occur regardless of the indoor temperature of the entire target zone 10 being included in the comfortable temperature range. According to the present invention, since one object is that the indoor temperatures of all points of the target zone 10 are intended to be included in the comfortable temperature range, step S12 may be performed in order to implement the object.

When each indoor temperature for each temperature sensor is not included in the comfortable temperature range, that is, when the indoor temperature of at least one temperature sensor 30 among the temperature sensors 30 are included in the first or second non-comfortable temperature range, steps S13 to S15 may be performed, and then step S12 may be performed again.

Specifically, in step S13, the management server 70 may calculate ranking information of the temperature sensors 30 based on the indoor temperature for each temperature sensor and the comfortable temperature range.

According to the exemplary embodiment, the management server 70 may align the temperature sensor for each temperature sensor in an order in which a difference value between the indoor temperature of the temperature and the comfortable temperature range is the larger, and calculate the ranking information of the temperature sensors 30 according to the indoor temperature for each aligned temperature sensor.

In step S14, the management server 70 may select a first air conditioner 20 having temperature sensor influence ranking information most similar to the ranking information of the temperature sensors 30 among air conditioners 20 for which the combination desired temperature is not set.

Here, referring to FIG. 6, since steps S12 to S16 are repeatedly performed, the air conditioner 20 for which the combination desired temperature is not set may mean an air conditioner 20 other than the air conditioner 20 for which the combination desired temperature is set, such as the top-priority air conditioner 20.

According to the exemplary embodiment, the management server 70 compares a similarity between the temperature sensor influence ranking information of the air conditioner 20 for which the combination desired temperature is not set and the ranking information of the temperature sensors 30 based on a known similarity comparison algorithm to select the first air conditioner 20.

As an example, in an environment illustrated in FIG. 4, when air conditioner a 20*a* is the top-priority air conditioner 20 for which the combination desired temperature is set, the air conditioner 20 for which the combination desired temperature is not set may be air conditioner b 20*b* and air conditioner c 20*c*. In this case, it is assumed that the ranking information of the temperature sensors 30 is "b, c, d, a", the temperature sensor influence ranking information of air conditioner b 20*b* is "b, d, c, a", and the temperature sensor influence ranking information of air conditioner b 20*b* is "c, d, b, a". Meanwhile, a, b, c, and d mean temperature sensor a 30*a*, temperature sensor b 30*b*, temperature sensor c 30*c*, and temperature sensor d 30*d*, respectively, and it is assumed that indoor temperatures of temperature sensor b 30*b* and temperature sensor c 30*c* are not included in the comfortable temperature range. In this case, the management server 70 may calculate air conditioner b 20*b* as the first air conditioner 20.

In step S15, the management server 70 may set the desired temperature of the first air conditioner 20 which may implement the indoor temperature of the target zone 10 most similar to the comfortable temperature range as the combination desired temperature of the first air conditioner 20.

Figure 8:
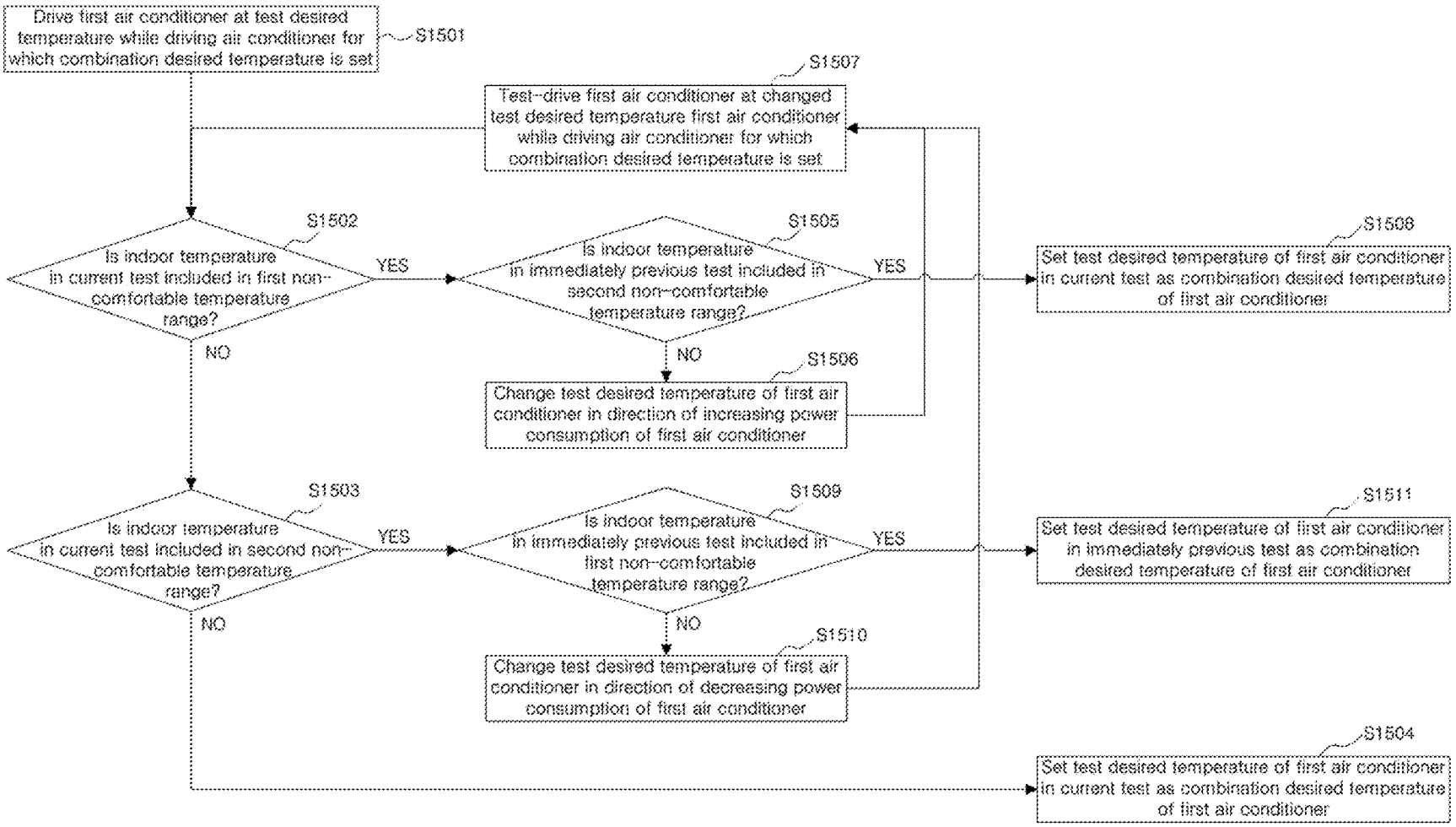

FIG. 8 is a diagram illustrating a flowchart of step S15 in FIG. 6.

Referring to FIG. 8, step S15 may be performed similarly to step S11 of FIG. 7. That is, in steps S1501 and S1507, except that the air conditioner 20 for which the combination desired temperature is set is driven jointly upon test driving, steps S1501 and S1511 of FIG. 8 correspond to steps S1101 and S1111 of FIG. 7. Therefore, step S15 will refer to the description of step S11.

For example, step S15 may be a step of setting the combination desired temperature of the first air conditioner 20 which may implement the indoor temperature of the target zone 10 most similar to the comfortable temperature range by test-driving the first air conditioner 20 at least once in a situation in which the air conditioner 20 for which the combination desired temperature is set is driven at the corresponding combination desired temperature.

Referring back to FIG. 6, step S15 may be performed, and then step S12 may be performed again. That is, the management server 70 may determine whether each temperature sensor-specific indoor temperature is included in the comfortable temperature range again.

Meanwhile, when each temperature sensor-specific indoor temperature is included in the comfortable temperature range, the management server 70 may complete setting the combination desired temperature of each of one or more air conditioners 20 which are combined and driven step S16. In this case, it may be set that the air conditioner 20 for which the combination desired temperature is not set is not driven.

That is, i) when all of the indoor temperatures of the temperature sensors 30 of the target zone 10 are included in the comfortable temperature range in the situation in which the top-priority air conditioner 20 is driven at the corresponding combination desired temperature, it may be set that only the top-priority air conditioner 20 is driven at the corresponding combination desired temperature, ii) when the indoor temperature of at least one temperature sensor 30 are not included in the comfortable temperature range in the situation in which the top-priority air conditioner 20 is driven at the corresponding combination desired temperature, it may be set that each of the top-priority air conditioner 20 and at least one air conditioner 20 is driven at the corresponding combination desired temperature, and iii) it may be set that air conditioners other than the top-priority air conditioner 20 and at least one air conditioner 20 is not driven.

The above-described contents are summarized as below.

The indoor temperature of the target zone 10 may correspond to an average value of individual indoor temperatures measured by the temperature sensors 30, respectively. In this case, even though the indoor temperature of the target zone 10 is included in the comfortable temperature range, some individual indoor temperatures may not be included in the comfortable temperature range. Therefore, the management server 20 may adjust the indoor temperature of the target zone 10 to be approximate to the comfortable temperature range based on the driving of the top-priority air conditioner 20, and when there are some individual indoor temperatures not included in the comfortable temperature range, only an air conditioner 20 which exerts a large influence on some individual indoor temperatures may be additionally driven. As a result, driving of an unnecessary air conditioner 20 may be prevented, and excessive cooling/heating which occurs at some points may be prevented, and the power consumption of the air conditioner 20 may be minimized while the indoor temperature of each point in the target zone 10 satisfies the comfortable temperature range.

Referring back to FIG. 5, in step S20, the management server 70 may collect base information measured when one or more air conditioners 20 are driven at corresponding combination desired temperatures.

Step S20 may be performed during a specific time interval of an additional test day after the test day.

The base information may be information on the temperature change of the target zone 10 according to the indoor/outdoor temperature difference in the target zone 10 when one or more air conditioners 20 are driven at the combination desired temperatures.

The indoor/outdoor temperature difference in the target zone 10 may correspond to a subtraction value ($T_o - T_i$) of the outdoor temperature of the target zone 10 and the indoor temperature of the target zone 10. In this case, the outdoor temperature of the target zone 10 may be collected from the weather server 80, and the indoor temperature of the target zone 10 may be measured by the temperature sensor 30.

The temperature change in the target zone 10 may be defined as a temperature change per unit time in the target zone 10. As an example, the unit time may be 1 hour, but the present invention is not limited thereto.

The base information may be collected at a predetermined cycle. As an example, when a length of the late night time interval is 1 hour, the base information may be collected per 10 minutes.

In step S30, the management server 70 may calculate the base relationship information of the target zone 10 based on the base information.

The base relationship information may be defined as a relationship information between the indoor/outdoor temperature difference of the target zone 10 and the temperature change of the target zone 10 when one or more air conditioners are driven.

According to the exemplary embodiment, the base relationship information may be expressed as a base relationship function equation corresponding to a trend line for a plurality of base information. According to the exemplary embodiment, the trend line may be a polynomial trend line, and in particular, may be a secondary polynomial trend line. That is, the base relationship information may correspond to a base relationship polynomial function equation that outputs the temperature change in the target zone 10 by setting the indoor/outdoor temperature difference as a variable. In this case, the base relationship information may be separately set in the cooling mode and a heating mode of the air conditioner 20.

Figure 9A:
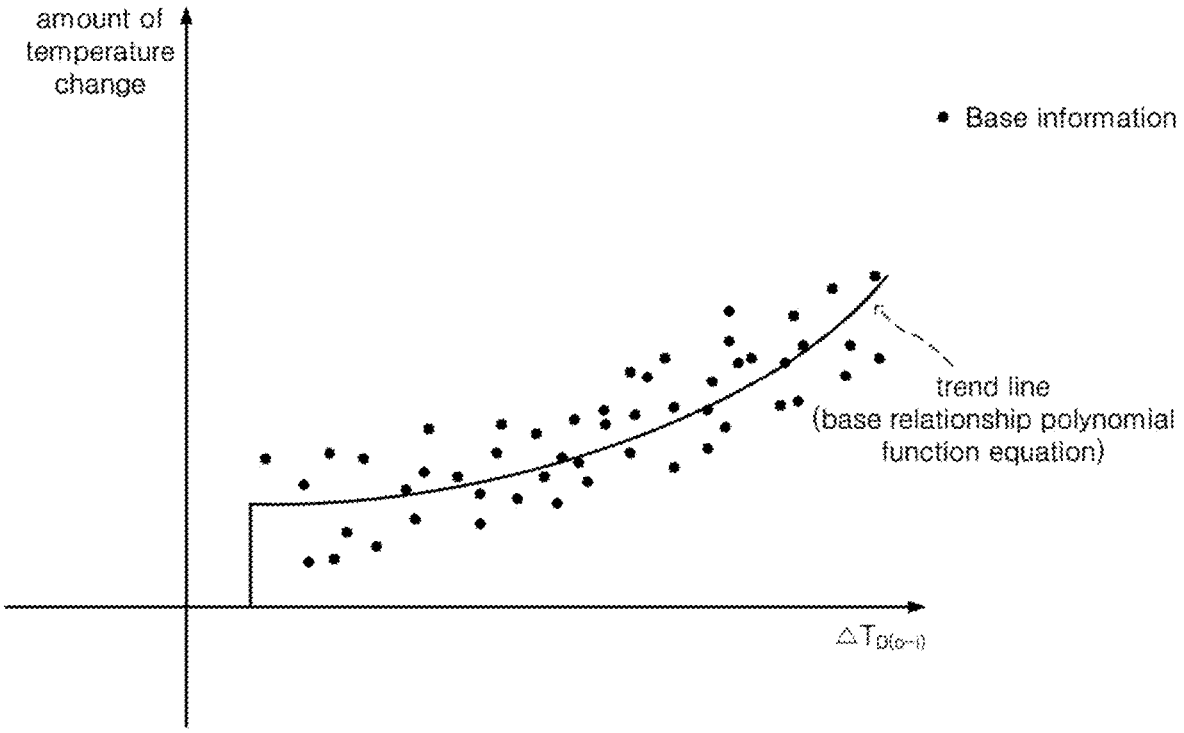
FIGS. 9A and 9B are diagrams illustrating examples of the base relationship information according to an exemplary embodiment of the present invention.
Figure 9B:
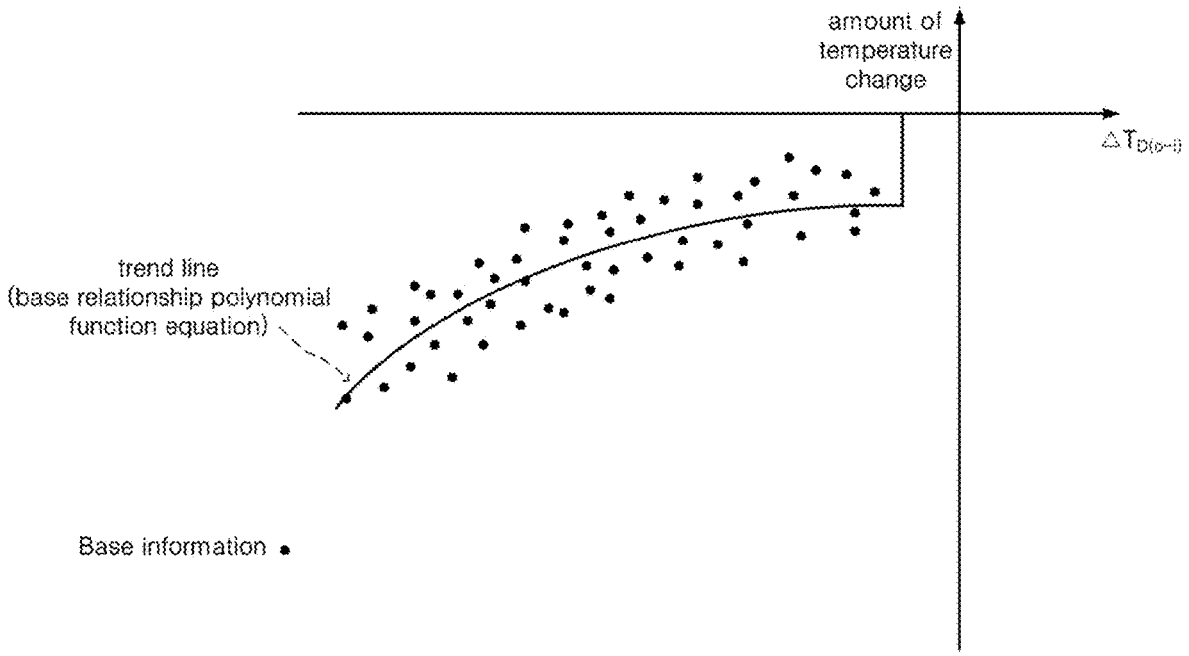

FIGS. 9A and 9B illustrate examples of a trend line based on the plurality of base information, i.e., the base relationship polynomial function equation. In this case, FIG. 9A illustrates the base relationship polynomial function equation for the cooling mode and FIG. 9B illustrates the base relationship polynomial function equation for the heating mode.

According to the exemplary embodiment, in each of the cooling mode and the heating mode, a function value of the base relationship polynomial equation may be expressed as in Equation 1 below.

$$f(\Delta T_{D(o-i)}) = a\Delta T_{D(o-i)}^2 + b\Delta T_{D(o-i)} + c \quad \text{[Equation 1]}$$

wherein, $\Delta T_{D(o-i)}$ represents the indoor/outdoor temperature difference in the target zone 10, $f(\Delta T_{D(o-i)})$ represents the temperature change in the target zone 10, a and b represent a coefficient of a variable term defined by the thermal feature of the target zone 10, and c represents a constant term defined by the thermal feature parameter of the target zone 10.

Meanwhile, the base relationship information may be used for predicting the temperature change of the target zone 10 at the target day. In particular, the management server 70 may calculate the target relationship information by reflecting weather information (e.g., cloud quantity information) of the target day to the base relationship information, and predict the temperature change of the target zone 10 based on the target relationship information.

For example, the base relationship information of the target zone 10 when one or more air conditioners 20 among the air conditioners 20 are driven is calculated to accurately predict the temperature change information of the target zone 10.

Meanwhile, the above-described contents described may also be performed by the control module 40 other than the management server 70. In this case, the control module 40 may include a high-performance processor based control unit, and further include the second short-range communication module and the infrared communication module. The control module may acquire weather information of the target zone 10 from the weather server 80 through the access point 60 and the gateway 50, and acquire indoor temperature and humidity of the target zone 10 measured by the temperature/humidity sensor 30 through the gateway 50. Further, the temperature/humidity sensor 30 and the control module 40 may be built in the air conditioner 20. In this case, the control module 40 may also directly acquire the indoor temperature and humidity from the temperature/humidity sensor 30. Since the performance operation of the control module 40 is similar to the above description, a detailed description will be omitted.

Although it is described that all components of an embodiment of the present invention are combined with each other or are operated while being combined with each other, the present invention is not necessarily limited thereto, and at least one of all the components may be operated while being selectively combined with each other without departing from the scope of the present invention. Although each of all the components may be embodied as independent hardware, some or all of the components may be selectively combined to realize a computer program having a program module which performs some or all of functions of a combination of one or more hardware units. Code and code segments constituting the computer program can be easily reasoned by those of ordinary skill in the art. The computer program may be stored in a computer-readable medium, and an embodiment of the present invention may be implemented by reading and executing the computer program. Examples of the computer-readable medium storing the computer program include a magnetic recording medium, an optical recording medium, and a storage medium with a semiconductor recording element. The computer program for implementing the present invention includes a program module transmitted in real time via an external device.

While embodiments of the present invention have been particularly described, various changes or modifications may be made therein by general technical experts. It is therefore to be understood that such changes and modifications are included within the scope of the present invention unless they depart from the scope of the present invention.

What is claimed is:

1. A method for determining a set temperature of each of a plurality of air conditioners installed in a target zone the method comprising:

obtaining an influence ranking for each air conditioner among the plurality of air conditioners;

determining a set temperature for a top-priority air conditioner, which is predetermined among the plurality of the air conditioners, the set temperature being determined to allow an indoor temperature to be within or adjacent to a predetermined comfortable temperature range, wherein the indoor temperature is an average value of temperatures measured from the plurality of temperature sensors; and in response to a measured temperature of at least one temperature sensor among the plurality of temperature sensors being outside the comfortable temperature range, performing following steps repeatedly until all of measured temperatures are within the comfortable temperature range:

obtaining a difference ranking while operating a first group of air conditioners among the plurality of air conditioners, for which the set temperatures have been determined, at the respective set temperatures;

comparing the difference ranking with the influence rankings of one or more air conditioners in a second group of air conditioners, for which set temperatures have not been determined;

selecting a first air conditioner, among the second group of air conditioners, whose influence ranking is most similar to the difference ranking; and determining a set temperature for the first air conditioner that allows the indoor temperature to be within or adjacent to the comfortable temperature range.

2. The method of claim 1, wherein said step of determining the set temperature for the top-priority air conditioner comprises:

operating the top-priority air conditioner at a first testing temperature;

measuring the indoor temperature while the top-priority air conditioner is operating at the first testing temperature;

in response to the indoor temperature being within a temperature range requiring a higher cooling/heating load to reach the comfortable temperature range, adjusting the top-priority air conditioner to a second testing temperature, which corresponds to a direction of increasing power consumption and is different from the first testing temperature by a unit temperature;

operating the top-priority air conditioner at the second testing temperature;

measuring the indoor temperature while the top-priority air conditioner is operating at the second testing temperature; and in response to the indoor temperature being within a temperature range requiring a lower cooling/heating load to reach the comfortable temperature range, assigning the first testing temperature as the set temperature for the top-priority air conditioner.

3. The method of claim 1, wherein said step of determining the set temperature for the top-priority air conditioner comprises:

operating the top-priority air conditioner at a first testing temperature;

measuring the indoor temperature while the top-priority air conditioner is operating at the first testing temperature;

in response to the indoor temperature being within a temperature range requiring a lower cooling/heating load to reach the comfortable temperature range, adjusting the top-priority air conditioner to a second testing temperature, which corresponds to direction of decreasing power consumption and is different from the first testing temperature by a unit temperature;

operating the top-priority air conditioner at the second testing temperature;

measuring the indoor temperature while the top-priority air conditioner is operating at the second testing temperature; and in response to the indoor temperature being within a temperature range requiring a higher cooling/heating load to reach the comfortable temperature range, assigning the second testing temperature as the set temperature for the top-priority air conditioner.

4. The method of claim 1, wherein during said step of determining the set temperature for the first air conditioner, the set temperature is determined to allow the indoor temperature of the target zone to correspond to:

temperature within the comfortable temperature range; or a temperature within a first non-comfortable temperature range wherein the first non-comfortable temperature range is a temperature range requiring a higher cooling/heating load to reach the comfortable temperature range.

5. The method of claim 1, wherein the influence ranking for each air conditioner among the plurality of air conditioners is obtained by steps comprising:

operating one air conditioner at a predetermined temperature set point while maintaining remaining air conditioners turned off;

measuring resulting temperatures using a plurality of temperature sensors disposed separately from the air conditioners in the target zone;

sorting a list of the plurality of temperature sensors such that the corresponding resulting temperatures are arranged in descending order; and assigning the sorted list as the influence ranking for said one air conditioner.

6. The method of claim 1, wherein the difference ranking is obtained by steps comprising:

operating the first group of air conditioners among the plurality of air conditioners, for which the set temperatures have been determined, at the respective set temperatures;

calculating, for each temperature sensor, a difference value between the measured temperature and the comfortable temperature range;

sorting the list of the plurality of temperature sensors such that the corresponding difference values are arranged in descending order; and assigning the sorted list as the difference ranking.

7. The method of claim 1, wherein said step of determining the set temperature of the top-priority air conditioner further comprises:

operating the top-priority air conditioner at a first testing temperature;

measuring the indoor temperature while the top-priority air conditioner is operating at the first testing temperature; and in response to the indoor temperature being within the comfortable temperature range, assigning the first testing temperature as the set temperature of the top-priority air conditioner.

8. An apparatus for determining a set temperature of each of a plurality of air conditioners installed in a target zone the apparatus comprising:

a memory storing computer-readable instructions; and a processor configured to execute the instructions, the instructions when executed configured to:

obtain an influence ranking for each air conditioner among the plurality of air conditioners;

determine a set temperature for a top-priority air conditioner, which is predetermined among the plurality of the air conditioners, the set temperature being determined to allow an indoor temperature to be within or adjacent to a predetermined comfortable temperature range, wherein the indoor temperature is an average value of temperatures measured from the plurality of temperature sensors; and in response to a measured temperature of at least one temperature sensor among the plurality of temperature sensors being outside the comfortable temperature range, perform following steps repeatedly until all of measured temperatures are within the comfortable temperature range:

obtaining a difference ranking while operating a first group of air conditioners among the plurality of air conditioners, for which the set temperatures have been determined, at the respective set temperatures;

comparing the difference ranking with the influence rankings of one or more air conditioners in a second group of air conditioners, for which set temperatures have not been determined;

selecting a first air conditioner, among the second group of air conditioners, whose influence ranking is most similar to the difference ranking; and determining a set temperature for the first air conditioner that allows the indoor temperature to be within or adjacent to the comfortable temperature range.

9. The apparatus of claim 8, wherein the influence ranking for each air conditioner among the plurality of air conditioners is obtained by steps comprising:

operating one air conditioner at a predetermined temperature set point while maintaining remaining air conditioners turned off;

measuring resulting temperatures using a plurality of temperature sensors disposed separately from the air conditioners in the target zone;

sorting a list of the plurality of temperature sensors such that the corresponding resulting temperatures are arranged in descending order; and assigning the sorted list as the influence ranking for said one air conditioner.

10. The apparatus of claim 8, wherein the difference ranking is obtained by steps comprising:

operating the first group of air conditioners among the plurality of air conditioners, for which the set temperatures have been determined, at the respective set temperatures;

calculating, for each temperature sensor, a difference value between the measured temperature and the comfortable temperature range;

sorting the list of the plurality of temperature sensors such that the corresponding difference values are arranged in descending order; and assigning the sorted list as the difference ranking.

11. The apparatus of claim 8, wherein said step of determining the set temperature of the top-priority air conditioner further comprises:

operating the top-priority air conditioner at a first testing temperature;

measuring the indoor temperature while the top-priority air conditioner is operating at the first testing temperature; and in response to the indoor temperature being within the comfortable temperature range, assigning the first testing temperature as the set temperature of the top-priority air conditioner.

12. The apparatus of claim 8, wherein said step of determining the set temperature for the top-priority air conditioner comprises:

operating the top-priority air conditioner at a first testing temperature;

measuring the indoor temperature while the top-priority air conditioner is operating at the first testing temperature;

in response to the indoor temperature being within a temperature range requiring a higher cooling/heating load to reach the comfortable temperature range, adjusting the top-priority air conditioner to a second testing temperature, which corresponds to a direction of increasing power consumption and is different from the first testing temperature by a unit temperature;

operating the top-priority air conditioner at the second testing temperature;

measuring the indoor temperature while the top-priority air conditioner is operating at the second testing temperature; and in response to the indoor temperature being within a temperature range requiring a lower cooling/heating load to reach the comfortable temperature range, assigning the first testing temperature as the set temperature for the top-priority air conditioner.

13. The apparatus of claim 8, wherein said step of determining the set temperature for the top-priority air conditioner comprises:

operating the top-priority air conditioner at a first testing temperature;

measuring the indoor temperature while the top-priority air conditioner is operating at the first testing temperature;

in response to the indoor temperature being within a temperature range requiring a lower cooling/heating load to reach the comfortable temperature range, adjusting the top-priority air conditioner to a second testing temperature, which corresponds to a direction of decreasing power consumption and is different from the first testing temperature by a unit temperature;

operating the top-priority air conditioner at the second testing temperature;

measuring the indoor temperature while the top-priority air conditioner is operating at the second testing temperature; and in response to the indoor temperature being within a temperature range requiring a higher cooling/heating load to reach the comfortable temperature range, assigning the second testing temperature as the set temperature for the top-priority air conditioner.

14. The apparatus of claim 8, wherein during said step of determining the set temperature for the first air conditioner, the set temperature is determined to allow the indoor temperature of the target zone to correspond to:

a temperature within the comfortable temperature range; or a temperature within a first non-comfortable temperature range, wherein the first non-comfortable temperature range is a temperature range requiring a higher cooling/heating load to reach the comfortable temperature range.

* * * * *